US010947070B2

(12) United States Patent
Mashiki

(10) Patent No.: US 10,947,070 B2
(45) Date of Patent: Mar. 16, 2021

(54) SHEET FEEDING ADAPTER

(71) Applicant: KYOCERA Document Solutions Inc., Osaka (JP)

(72) Inventor: Masami Mashiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/329,540

(22) PCT Filed: Oct. 30, 2017

(86) PCT No.: PCT/JP2017/039126
§ 371 (c)(1),
(2) Date: Feb. 28, 2019

(87) PCT Pub. No.: WO2018/088261
PCT Pub. Date: May 17, 2018

(65) Prior Publication Data

US 2019/0193961 A1 Jun. 27, 2019

(30) Foreign Application Priority Data

Nov. 9, 2016 (JP) ..... JP2016-219133

(51) Int. Cl.
*B65H 1/26* (2006.01)
*B65H 1/04* (2006.01)
*B65H 1/28* (2006.01)

(52) U.S. Cl.
CPC ..... *B65H 1/04* (2013.01); *B65H 1/266* (2013.01); *B65H 1/28* (2013.01); *B65H 2402/32* (2013.01);
(Continued)

(58) Field of Classification Search
CPC B65H 2405/332; B65H 2405/33; B65H 3/44; B65H 1/04; B65H 1/266;
(Continued)

(56) References Cited

U.S. PATENT DOCUMENTS 4,017,181 A * 4/1977 Komaba ..... B62L 3/02 355/72
7,600,745 B2 * 10/2009 Asada ..... B65H 3/0684 271/9.08
(Continued)

FOREIGN PATENT DOCUMENTS

JP 57072543 A * 5/1982
JP 60056740 A * 4/1985 ..... B65H 3/44
(Continued)

OTHER PUBLICATIONS

International Search Report dated Dec. 12, 2017 in corresponding International Application No. PCT/JP2017/039126.

*Primary Examiner* — Luis A Gonzalez
(74) *Attorney, Agent, or Firm* — Wenderoth, Lind & Ponack, L.L.P.

(57) ABSTRACT

A sheet feeding adapter includes a base plate which is placed on an upper surface of a sheet bundle set in a sheet feeding cassette and having a predetermined size and movable in a sheet feeding direction through guidance of a pair of first regulating plates, a sheet bundle having a small width size being set on an upper surface of the base plate, and a pair of second regulating plates that are upright from the upper surface of the base plate and regulate a position in a width direction of a sheet bundle set on the upper surface of the base plate and having a small width size, wherein the base plate is movable between a sheet feeding position, at which the sheet bundle having the small width size can be fed, and a withdrawing position positioned at a rear side from the sheet feeding position.

6 Claims, 8 Drawing Sheets

(52) U.S. Cl.
CPC .. *B65H 2405/324* (2013.01); *B65H 2405/332* (2013.01); *B65H 2511/10* (2013.01); *B65H 2511/12* (2013.01); *B65H 2801/06* (2013.01)

(58) Field of Classification Search
CPC .. B65H 1/28; B65H 2511/12; B65H 2511/10; B65H 2405/324
See application file for complete search history.

(56) References Cited

U.S. PATENT DOCUMENTS

| | | | |
|---|---|---|---|
| 2007/0069447 | A1 | 3/2007 | Watanabe |
| 2008/0296827 | A1 | 12/2008 | Chino |

FOREIGN PATENT DOCUMENTS

| | | | | |
|---|---|---|---|---|
| JP | 61277525 | A | * | 12/1986 |
| JP | 03166134 | A | * | 7/1991 |
| JP | 5-139545 | | | 6/1993 |
| JP | 11059925 | A | * | 3/1999 |
| JP | 2001-301994 | | | 10/2001 |
| JP | 2002037469 | A | * | 2/2002 |
| JP | 2004-155515 | | | 6/2004 |
| JP | 2006-21841 | | | 1/2006 |
| JP | 2007-91429 | | | 4/2007 |
| JP | 2008-297053 | | | 12/2008 |

* cited by examiner

SHEET FEEDING ADAPTER

TECHNICAL FIELD

The present invention relates to a sheet feeding adapter that is mounted in a sheet feeding cassette having a pair of first regulating plates for regulating a position in a width direction of sheets stacked in a bundle shape and having a predetermined size and enables the use of a sheet having a small width size in which a width size is smaller than that of the sheets having the predetermined size.

BACKGROUND ART

In the related art, there has been known a sheet feeding adapter that is mounted in a sheet feeding cassette in which sheets having a predetermined size are stored and enables the use of a sheet having a size different from the predetermined size (for example, see Patent Literature 1). In the sheet feeding adapter, a sheet placing surface is formed in a curved shape such that a long size sheet, in which a dimension in a sheet feeding direction is longer than a sheet having a predetermined size, can be fed. The sheet feeding adapter is placed on a board provided in the sheet feeding cassette and is used. The board is used in order to set a sheet having a predetermined size. When a long size sheet is used, a user takes out the sheet set on the board and having the predetermined size out of the sheet feeding cassette and fixes the sheet feeding adapter to the board.

CITATION LIST

Patent Literature

Patent Literature 1: Japanese Unexamined Patent Application Publication No. 5-139545

SUMMARY OF INVENTION

Technical Problem

There is a case where the aforementioned sheet feeding cassette is provided on the cassette bottom surface thereof with a pair of regulating plates that regulate a position in a width direction of the sheet set on the board and having the predetermined size. In this sheet feeding cassette, it is not possible to use a sheet having a small width size in which a width size is smaller than that of the sheet having the predetermined size. Therefore, a user needs to separately purchase a dedicated sheet feeding cassette in which an interval of the regulating plates has changed. However, the purchase of the dedicated sheet feeding cassette in order to use the sheet of the small width size hardly used causes an increase in a load of a user in terms of cost. Furthermore, an increase in a sheet feeding cassette causes reduction of space efficiency.

In this regard, it is considered to set a sheet having a small width size in a sheet feeding cassette by using the sheet feeding adapter as disclosed in the Patent Literature 1. However, in the sheet feeding adapter, when the sheet having the small width size is used, a sheet in the sheet feeding cassette is taken out of the sheet feeding cassette and then the sheet feeding adapter is set on a board. Then, when the use of the sheet having the small width size is ended, it is necessary to detach the sheet feeding adapter and return the sheet into the sheet feeding cassette again. Therefore, there is a problem that the exchange work of the sheet feeding adapter is troublesome to a user.

The present invention has been made to solve the aforementioned problems, and an object of the present invention is to provide an inexpensive sheet feeding adapter that enables the use of a sheet having a small width size different from a predetermined size through simple work without giving a feeling of troublesomeness to a user.

Solution to Problem

A sheet feeding adapter according to the present invention is mounted in a sheet feeding cassette having a pair of first regulating plates for regulating a position in a width direction of sheets stacked in a bundle shape and having a predetermined size and enables use of a sheet having a small width size in which a width size is smaller than a width size of the sheets having the predetermined size.

The sheet feeding adapter includes a base plate configured to be placed on an upper surface of a sheet bundle set in the sheet feeding cassette and having the predetermined size and to be movable in a sheet feeding direction through guidance of the pair of first regulating plates, a sheet bundle having a small width size being set on an upper surface of the base plate, and a pair of second regulating plates that are upright from the upper surface of the base plate and regulate a position in a width direction of the sheet bundle of the small width size set on the upper surface of the base plate, wherein the base plate is configured to be movable to a sheet feeding position, at which the sheet bundle set on the base plate and having the small width size is positioned at a lower side of a predetermined sheet feeding member, and a withdrawing position at which the sheet bundle having the small width size is positioned at a rear side in the sheet feeding direction from the predetermined sheet feeding member.

Advantageous Effects of Invention

According to the present invention, it is possible to provide an inexpensive sheet feeding adapter that enables the use of a sheet having a small width size different from a predetermined size through simple work without giving a feeling of troublesomeness to a user.

DESCRIPTION OF EMBODIMENTS

Hereinafter, embodiments of the present invention will be described in detail on the basis of the drawings. It is noted that the present invention is not limited to the following embodiments.

Embodiment

Figure 1:
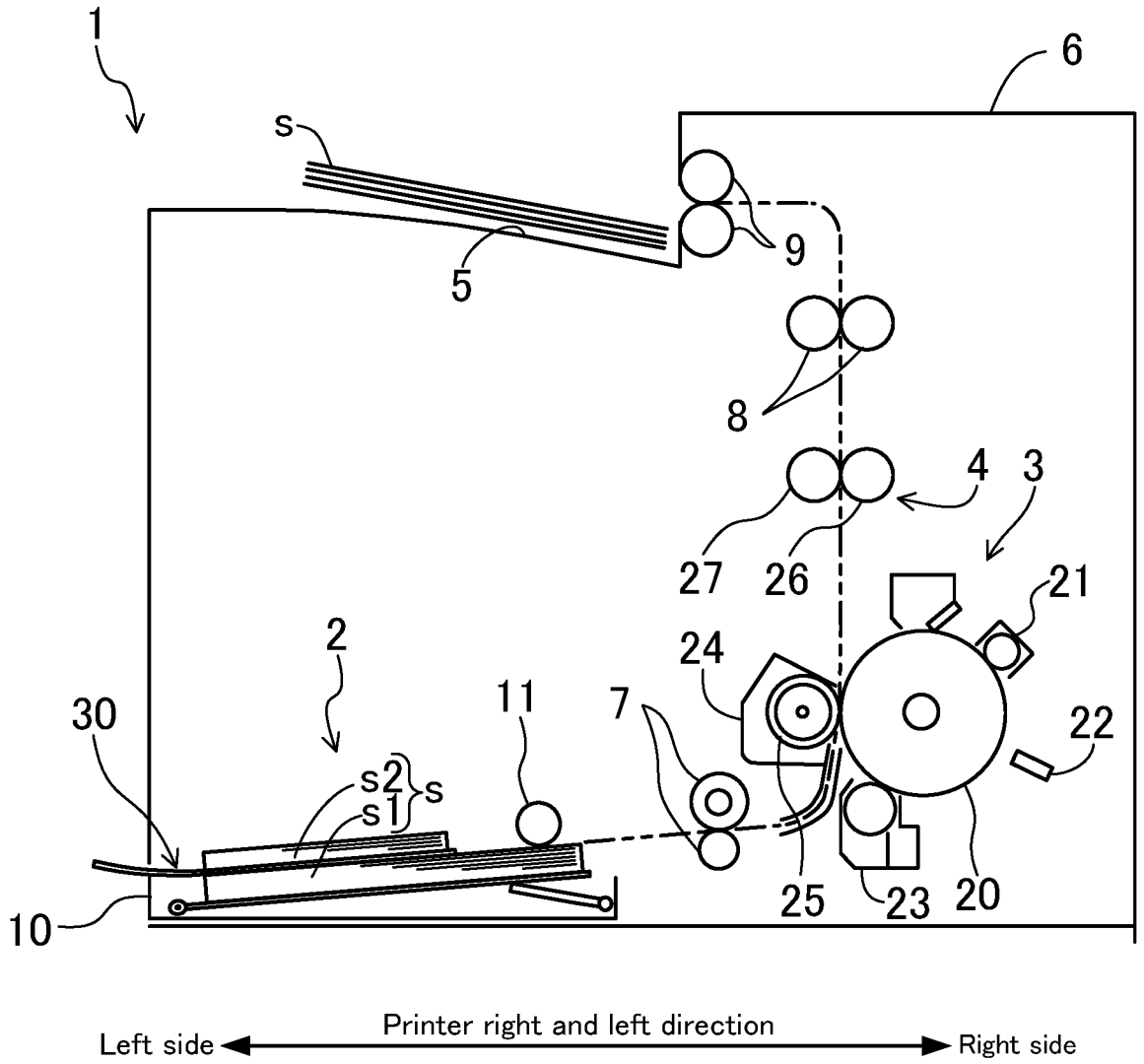
FIG. 1 is a schematic view illustrating an overall configuration of an image forming apparatus including a sheet feeding cassette mounted with a sheet feeding adapter in an embodiment.

FIG. 1 illustrates an image forming apparatus 1 in the present embodiment. In the present embodiment, the image forming apparatus 1 is a monochrome laser printer.

The image forming apparatus 1 has a sheet feeding unit 2, an image generation unit 3, a fixing unit 4, a sheet discharge unit 5, and a casing 6. On a sheet conveyance path from the sheet feeding unit 2 to the sheet discharge unit 5, a plurality of conveying roller pairs 7 to 9 are disposed to convey a sheet s (for example, an OHP sheet, a recording sheet and the like) while interposing the sheets therebetween. The sheet feeding unit 2 is disposed at a lower part of the casing 6. The sheet feeding unit 2 has a sheet feeding cassette 10 that stores the sheet s and a pick-up roller 11 that takes out the sheet s in the sheet feeding cassette 10 and sends the taken-out sheet s out of the cassette. The pick-up roller 11 is configured separately from the sheet feeding cassette 10 and is fixed to the casing 6. The sheet s sent out of the cassette by the sheet feeding cassette 10 is supplied to the image generation unit 3 via the conveying roller pair 7.

The image generation unit 3 has a photosensitive drum 20, a charging device 21, an exposing device 22, a developing device 23, a transfer device 24, and a toner container (not illustrated). In the image generation unit 3, a peripheral surface of the photosensitive drum 20 is charged by the charging device 21, and then laser light based on document image data (for example, image data of a document image received from an external terminal) is irradiated to the surface of the photosensitive drum 20 by the exposing device 22, so that an electrostatic latent image is formed. The electrostatic latent image formed (carried) on the surface of the photosensitive drum 20 is developed by the developing device 23 as a toner image. The toner image developed by the developing device 23 is transferred to the sheet s, which is supplied from the sheet feeding unit 2, by the transfer device 24. The sheet s after the transfer is supplied to the fixing unit 4 by a transfer roller 25 of the transfer device 24 and the photosensitive drum 20.

The fixing unit 4 has a heating roller 26 and a pressure roller 27 brought into press-contact with the heating roller 26 with a predetermined press-contact load. Inside the heating roller 26, a halogen lamp (not illustrated) is disposed as a heating means. A peripheral surface of the heating roller 26 is heated by heat generated from the halogen lamp.

The fixing unit 4 presses and heats the sheet s supplied from the image generation unit 3 between the heating roller 26 and the pressure roller 27, thereby fixing the toner image to the sheet s. Then, the sheet s with the toner image fixed by the fixing unit is sent to a downstream side by the heating roller 26 and the pressure roller 27. The sent sheet s is discharged to the sheet discharge unit 5 formed on an upper surface of the casing 6 by the plurality of conveying roller pairs 7 to 9.

The sheet feeding cassette 10 is inserted into the sheet feeding unit 2 in the image forming apparatus 1 from a cassette insertion opening formed at a lower end of a lateral side of the image forming apparatus 1. The sheet feeding cassette 10 can store therein a sheet bundle S1 including a sheet s1 having a prescribed predetermined size and a sheet bundle S2 including a sheet s2 having a small width size, in which a width size is smaller than that of the sheet s1 having the predetermined size. In the present embodiment, the predetermined size is, for example, a A4 size, and the small width size is, for example, a A5 size. The sheet bundle S1 having the predetermined size is directly set to the sheet feeding cassette 10 and the sheet bundle S2 having the small width size is set to the sheet feeding cassette 10 via a sheet feeding adapter 30. Details of the sheet feeding adapter 30 will be described later.

Figure 2:
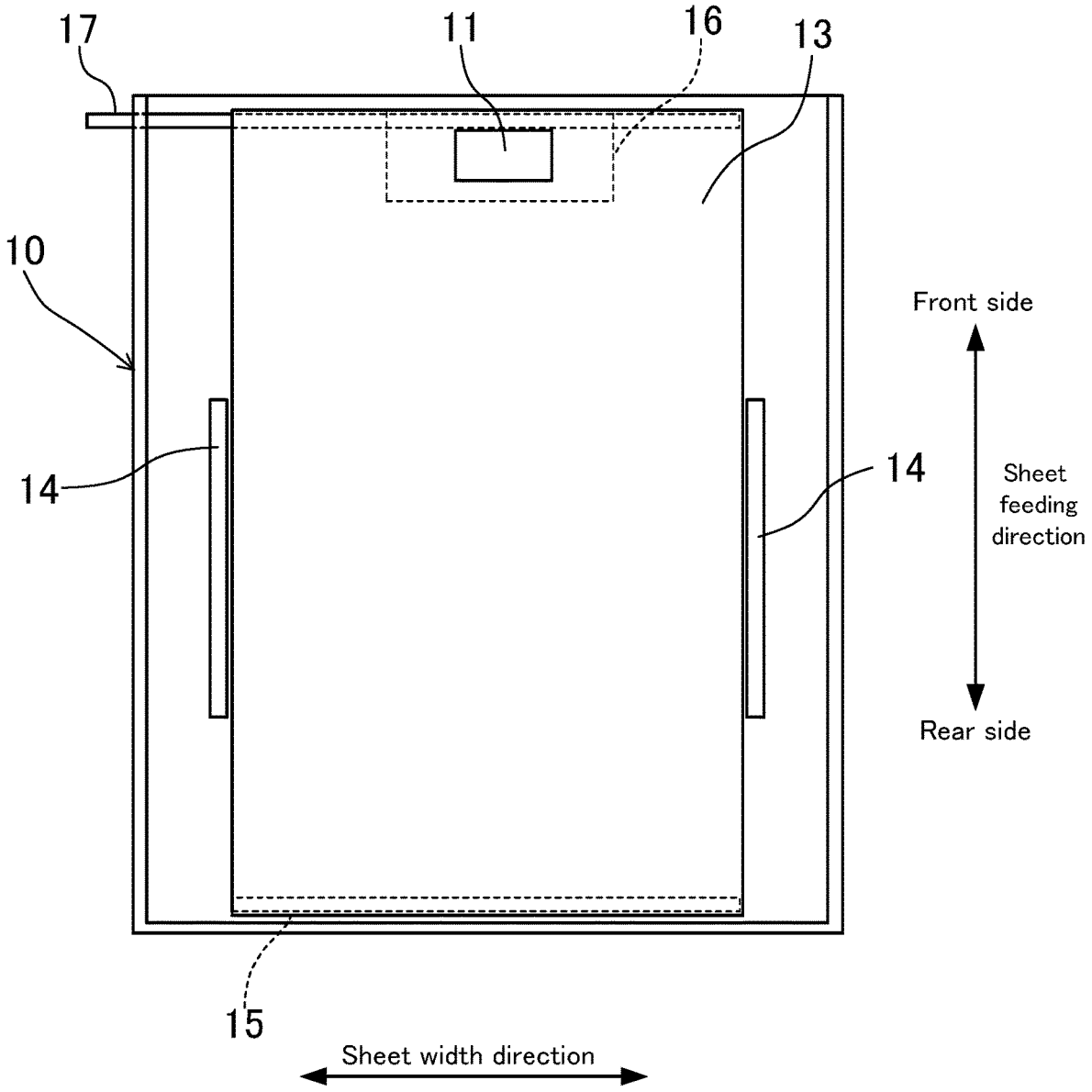
FIG. 2 is a plan view illustrating a schematic configuration of a sheet feeding cassette.
Figure 3:
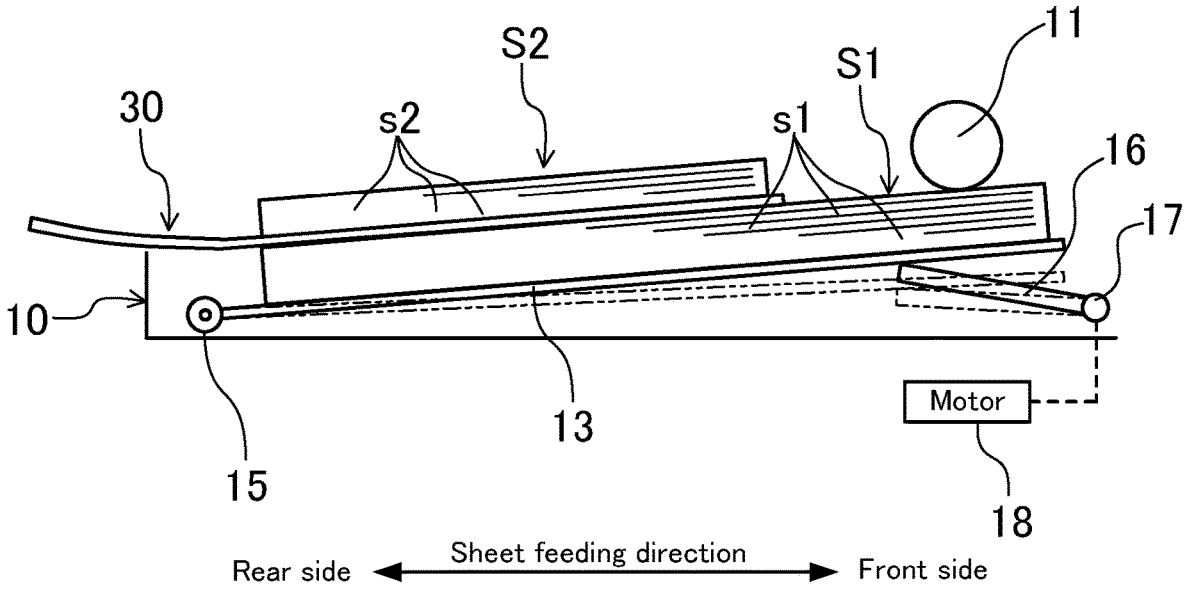
FIG. 3 is a side view schematically illustrating a sheet feeding mechanism.

As illustrated in FIG. 2 and FIG. 3, the sheet feeding cassette 10 has a rectangular box shape opened frontward and upward in a sheet feeding direction. Inside the sheet feeding cassette 10, a lift plate 13 is disposed, wherein the sheet bundle S1 having the predetermined size is placed on an upper surface of the lift plate 13. On a cassette bottom surface of the sheet feeding cassette 10, a pair of width regulating plates (first regulating plates) 14 are vertically installed to regulate a position in a width direction of the sheet bundle S1 having the predetermined size. The pair of width regulating plates 14 are disposed spaced apart from each other in a sheet width direction. The interval between the pair of width regulating plates 14 is set to be identical to the width size of the sheet s1 having the predetermined size.

One end (a left end of FIG. 3) of the lift plate 13 is pivotally supported to the cassette bottom side through a shaft 15. At the cassette bottom side of the sheet feeding cassette 10, a shaft 17 is disposed in parallel to the shaft 15, and one end (a right end of FIG. 3) of a lever 16 is integrally and rotatably connected to the shaft 17. The other end (the left end of FIG. 3) of the lever 16 abuts the other end (the right end of FIG. 3) of the lift plate 13 from below.

One end of the shaft 17 protrudes outward from the sheet feeding cassette 10 and the protruding end is connected to a motor 18, so that the shaft 17 is rotated by the start of the motor 18. In this way, the lever 16 is moved up and down by employing the shaft 17 as a fulcrum, so that the lift plate 13 is lifted up and down. When the sheet feeding cassette 10 is taken out from the sheet feeding unit 2, the connection between the shaft 17 and the motor 18 is released and the lever 16 moves down by its weight, so that the lift plate 13 is lifted down along the cassette bottom surface. On the other hand, when the sheet feeding cassette 10 is inserted into and is disposed in the sheet feeding unit 2, the shaft 17 is connected to the motor 18 and rotates in a counterclockwise direction of FIG. 3, so that the lift plate 13 is lifted up by the lever 16. The lift plate 13 is lifted up until the uppermost surface of the sheet bundle S1 (or S2) abuts the pick-up roller 11.

Figure 4:
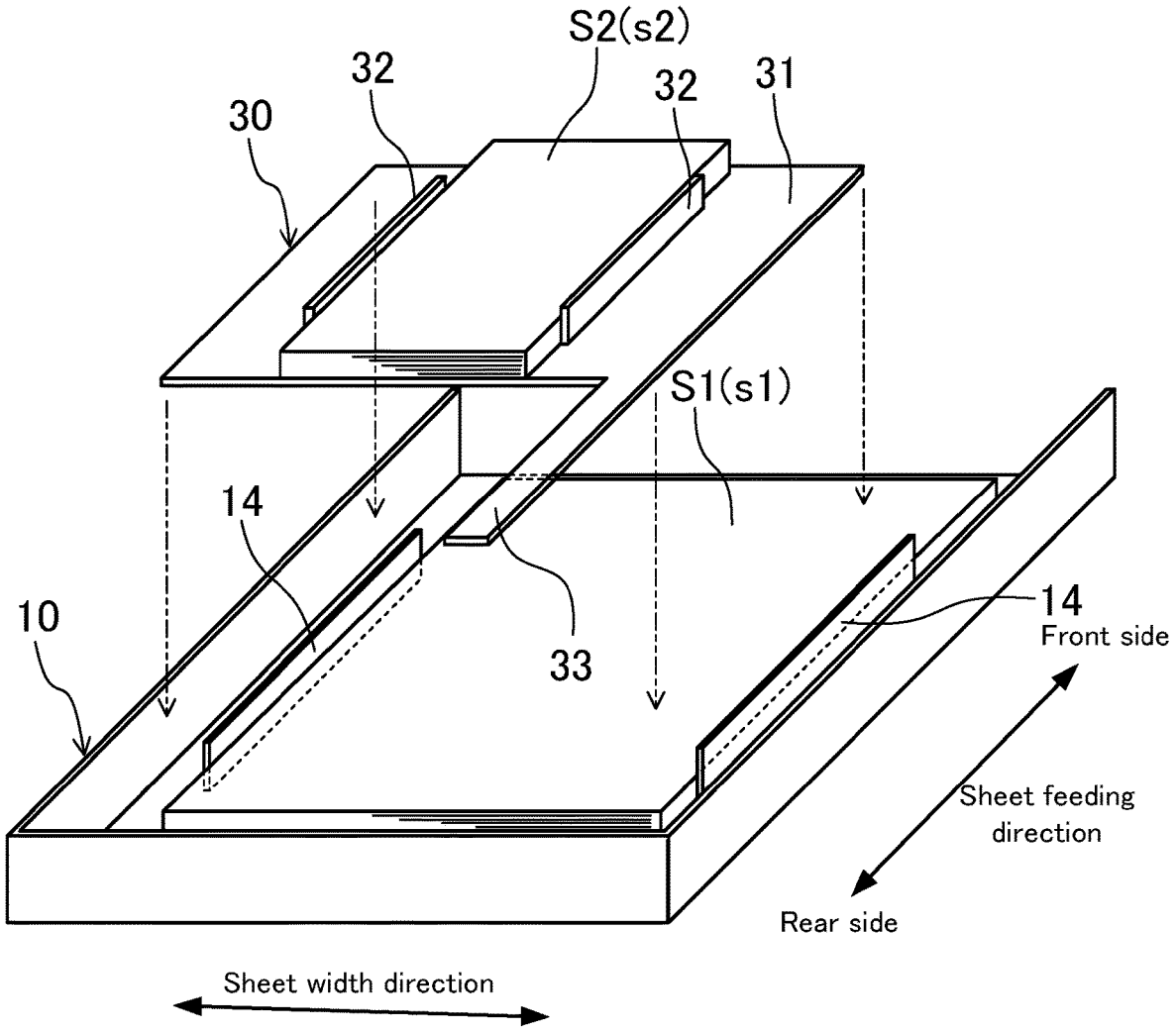
FIG. 4 is a perspective view separately illustrating a sheet feeding cassette and a sheet feeding adapter mounted in a sheet feeding cassette.
Figure 5:
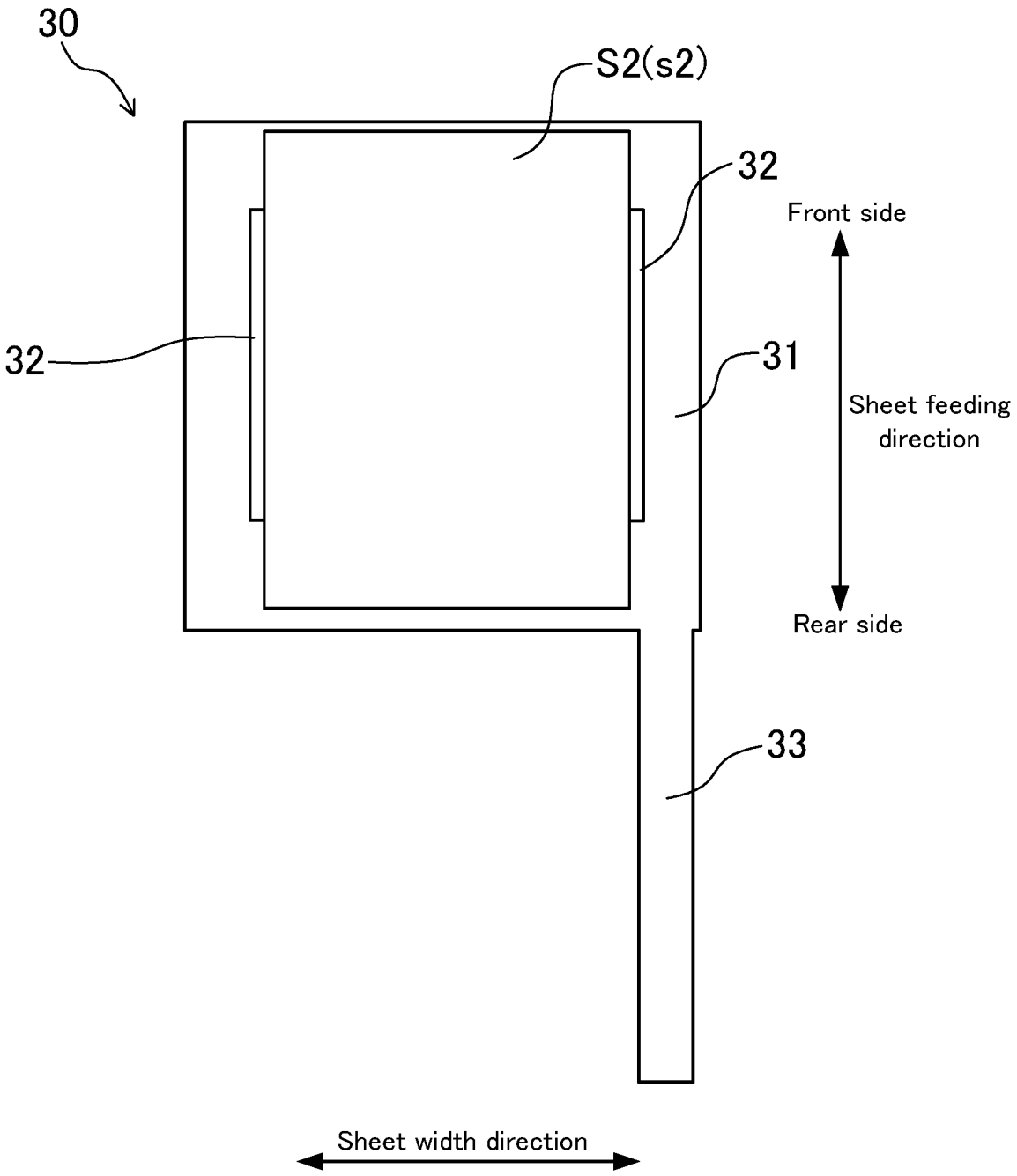
FIG. 5 is a plan view of a sheet feeding adapter.
Figure 6:
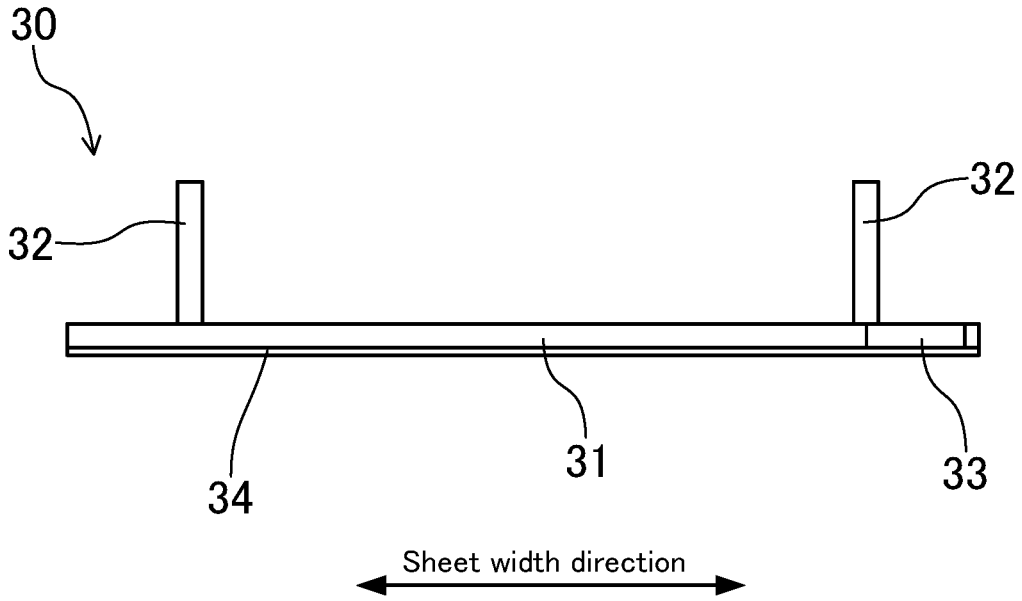
FIG. 6 is a side view when a sheet feeding adapter is viewed from a rear side in a sheet feeding direction.

As illustrated in FIG. 4, in the sheet feeding cassette 10, the sheet feeding adapter 30 can be mounted in order to set the sheet bundle S2 having the small width size. FIG. 5 is a plan view of the sheet feeding adapter 30 and FIG. 6 is a side view when the sheet feeding adapter 30 is viewed from the sheet feeding direction.

The sheet feeding adapter 30 has a base plate 31, a pair of regulating plates (second regulating plates) 32, and a grip part 33. The sheet feeding adapter 30, for example, is formed by a thick sheet such as a corrugated cardboard. The sheet feeding adapter 30, for example, may be made of a resin or a metal.

The base plate 31 has a rectangular plate shape and is placed on an upper surface (an upper surface of the uppermost sheet s1) of the sheet bundle S1 set in the sheet feeding cassette 10 and having the predetermined size. On the upper surface of the base plate 31, the sheet bundle S2 having the small width size is set. A length of the base plate 31 in the sheet width direction is set to be identical to (equal to or slightly smaller than) the interval between the pair of width regulating plates 14 upright from the cassette bottom surface of the sheet feeding cassette 10. A length of the base plate 31 in the sheet feeding direction is sufficiently smaller than that of the sheet feeding cassette 10 in the sheet feeding direction. The base plate 31 is guided by the pair of width regulating plates 14 and can slide along the upper surface of the sheet bundle S1 in the sheet feeding direction.

The base plate 31 is provided on the lower surface thereof with a low friction layer 34 for reducing frictional force acting on the lower surface of the sheet bundle S1 from the upper surface. A frictional coefficient of the low friction layer 34 to the sheet s1 is smaller than that of a material of the base plate 31 to the sheet s1. The low friction layer 34, for example, is formed by performing a coating process on the lower surface of the base plate 31.

The pair of regulating plates 32 are upright from the upper surface of the base plate 31 and are disposed spaced apart from each other in the sheet width direction. The pair of regulating plates 32 are fixed to the upper surface of the base plate 31 by an adhesive and the like. The interval between the pair of regulating plates 32 regulates the position in the width direction of the sheet bundle S2 placed on the upper surface of the base plate 31 and having the small width size. The interval between the pair of regulating plates 32 is set to be identical to (equal to or slightly smaller than) the width size of the sheet s2 having the small width size.

The grip part 33 extends in a belt shape frontward from a front end of the base plate 31 in the sheet feeding direction. The grip part 33 is connected to one end of the base plate 31 in the sheet width direction. The grip part 33 has a width to the extent that a user can grasp the grip part with his/her hand.

Figure 7:
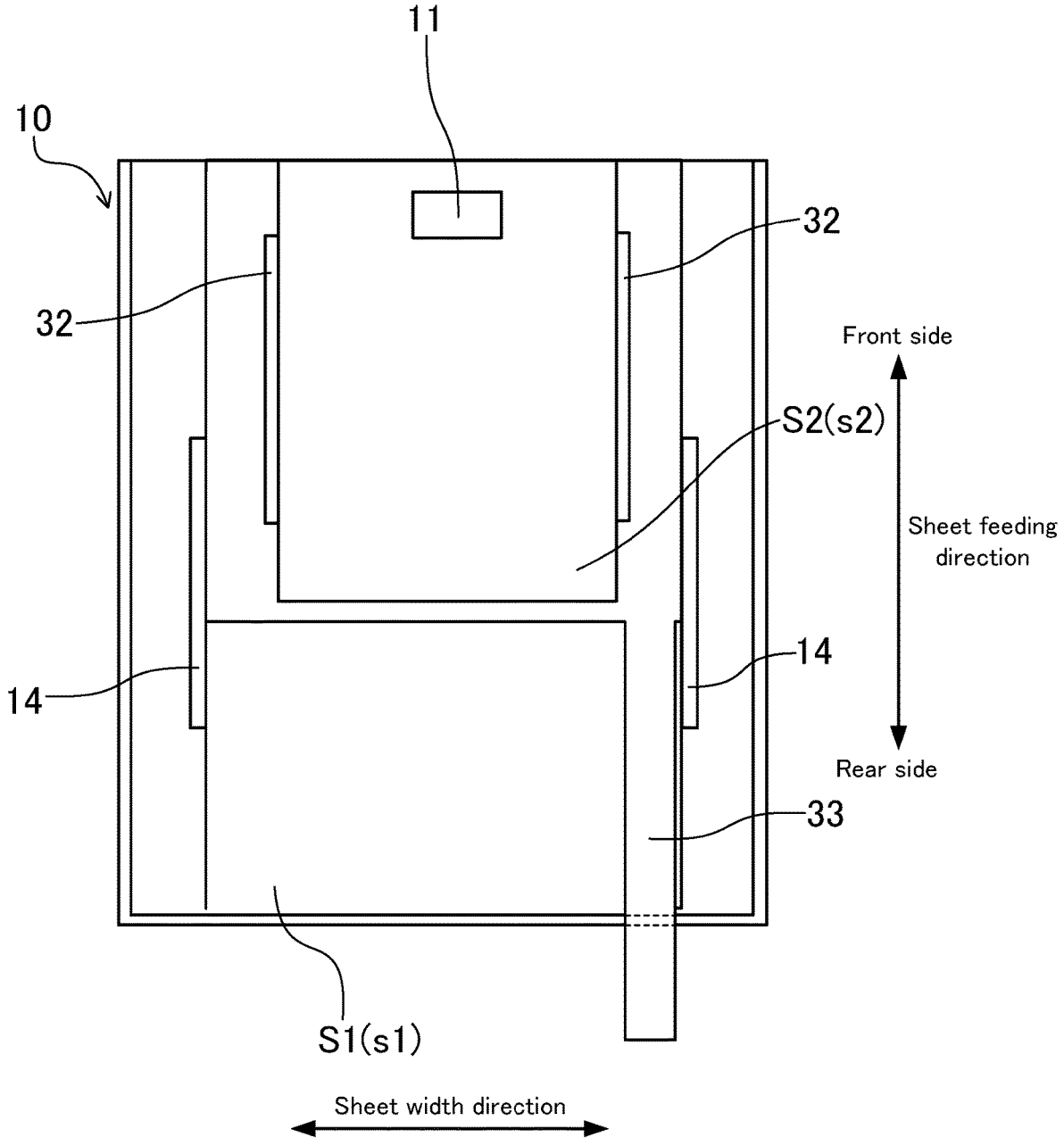
FIG. 7 is a plan view illustrating a state in which a sheet feeding adapter is in a sheet feeding position.
Figure 8:
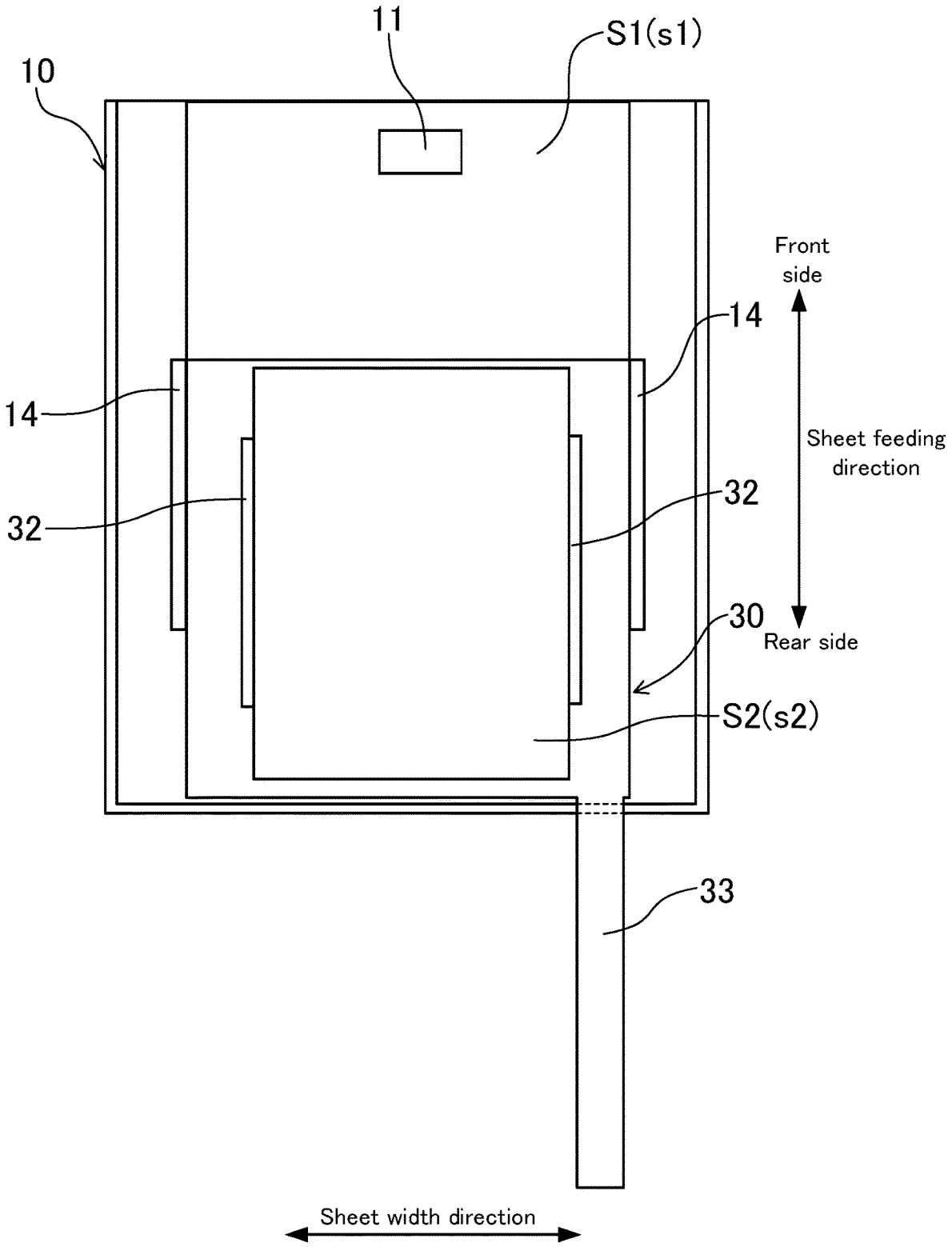
FIG. 8 is a plan view illustrating a state in which a sheet feeding adapter is in a withdrawing position.

The base plate 31 slides in the sheet feeding direction and can move to a sheet feeding position (a position of FIG. 7) and a withdrawing position (a position of FIG. 8).

In the sheet feeding position, the front end position of the base plate 31 approximately coincides with the front end position of the sheet feeding cassette 10, and the front end of the sheet bundle S2 of the small width size set on the base plate 31 and is positioned at the lower side of the pick-up roller 11. Consequently, when the lift plate 13 in the sheet feeding cassette 10 is lifted up, the upper surface of the sheet bundle S2 having the small width size abuts the pick-up roller (a predetermined sheet feeding member) 11, so that the sheet s2 having the small width size can be fed by the pick-up roller 11.

On the other hand, in the withdrawing position, the rear end of the base plate 31 is withdrawn near the rear end of the sheet feeding cassette 10, so that the front end of the sheet bundle S2 set on the base plate 31 and having the small width size moves to a rear side in the sheet feeding direction from the pick-up roller 11. In this way, the upper surface of the sheet bundle S1 set at the lower side of the sheet feeding adapter 30 and having the predetermined size is exposed. Consequently, when the lift plate 13 in the sheet feeding cassette 10 is lifted up, the uppermost surface of the sheet bundle S2 having the small width size does not abut the pick-up roller 11 and the upper surface of the sheet bundle S1 having the predetermined size abuts the pick-up roller 11. Thus, in the withdrawing position, the feeding of the sheet s2 having the small width size is not possible, but the sheet s1 having the predetermined size can be fed by the pick-up roller 11.

When the base plate 31 is moved between the sheet feeding position and the withdrawing position, it is sufficient if a user grasps the grip part 33 with his/her hand and pulls and pushes the grip part 33 in the sheet feeding direction in a state in which the lift plate 13 has been lifted down through the taking-out and the like of the sheet feeding cassette 10. As illustrated in FIG. 1, the grip part 33 protrudes to the outside of the image forming apparatus 1 from a gap formed between the cassette insertion opening of the lateral side of the image forming apparatus 1 and a sidewall of the sheet feeding cassette 10. The grip part 33 has a length to the extent that the rear end of the grip part 33 protrudes to the outside of the sheet feeding cassette 10 (the outside of the image forming apparatus 1) even though the sheet feeding adapter 30 is in the sheet feeding position (see FIG. 7). Furthermore, the grip part 33 is configured to be flexible in an arch shape when viewed from the sheet width direction. In other words, the grip part 33 has flexibility in a thickness direction. In this way, even though the thickness of the sheet bundle S1 set in the sheet feeding cassette 10 and having the predetermined size is reduced (the remaining number of the sheet s1 is reduced), since the grip part 33 is bent in an arch shape, the base plate 31 does not float up from the upper surface of the sheet bundle S1.

As described above, in the present embodiment, the sheet feeding adapter 30 is simply placed on the upper surface of the sheet bundle S1 set in the sheet feeding cassette 10 and having the predetermined size, so that the sheet bundle S2 having the small width size narrower than the predetermined size can be feed to the image generation unit 3.

Consequently, it is not necessary to separately provide the sheet feeding cassette 10 in order to set the sheet bundle S2 having the small width size, so that space saving can be achieved. Furthermore, the configuration of the sheet feeding adapter 30 is simpler than that of the sheet feeding cassette 10, so that it is possible to reduce cost as compared with a case where the sheet feeding cassette 10 is separately purchased.

Furthermore, in a state in which the sheet bundle S1 having the predetermined size has been set in the sheet feeding cassette 10, since the sheet feeding adapter 30 can be mounted, a user needs not to take out the sheet bundle S1 in the sheet feeding cassette 10 in order to use the sheet bundle S2 having the small width size or needs not to return the sheet bundle S1 having the predetermined size to the sheet feeding cassette 10 after the use of the sheet bundle S2 having the small width size. Thus, a workload when a user uses the sheet bundle S2 having the small width size is reduced, so that it is possible to reduce troublesomeness of the user.

Furthermore, the grip part 33 graspable by a user extends from the base plate 31 of the sheet feeding adapter 30, so that a user can allow the base plate 31 to easily slide in the sheet feeding direction via the grip part 33.

Furthermore, the sheet feeding adapter 30 is provided on the lower surface of the base plate 31 thereof with the low friction layer 34 in which a frictional coefficient to the upper surface (the sheet s1) of the sheet bundle S1 is smaller than that of a material constituting the base plate 31. Consequently, when the base plate 31 is moved between the sheet feeding position and the withdrawing position, frictional force acting on the base plate 31 from the upper surface of the sheet bundle S1 is minimized, so that it is possible to smoothly move the sheet feeding adapter 30.

Other Embodiments

In the aforementioned embodiment, the regulating plates 32 are fixed to the base plate 31 by an adhesive; however, the present invention is not limited thereto and the base plate 31, the regulating plates 32, and the grip part 33 may be integrally formed with one another by one thick sheet (for example, a corrugated cardboard and the like and a sheet having stiffness higher than the normal sheets s1 and s2). In such a case, it is sufficient if the regulating plates 32 are formed by bending a thick sheet and allowing the thick sheet to be superposed in the sheet width direction.

In this way, the manufacturing of the sheet feeding adapter 30 is facilitated, so that it is possible to reduce the manufacturing cost.

In the aforementioned embodiment, the position of the pair of width regulating plates 14 upright from the cassette bottom surface of the sheet feeding cassette 10 is fixed; however, the present invention is not limited thereto and for example, the position of the pair of width regulating plates 14 in the sheet width direction may be adjusted using a rack and pinion mechanism. In such a case, the sheet having the predetermined size indicates a sheet having a minimum width among a plurality of types of sheets which can be stored by moving the pair of width regulating plates 14, and the sheet having the small width size indicates a sheet having a width size smaller than the minimum width.

In the aforementioned embodiment, an example in which the image forming apparatus 1 is a laser printer has been described; however, the present invention is not limited thereto and the image forming apparatus 1, for example, may be a copy machine, a multifunctional peripheral (MFP), a facsimile and the like.

INDUSTRIAL APPLICABILITY

As described above, the present invention is useful for a sheet feeding adapter.

The invention claimed is:

1. A sheet feeding adapter, which is mounted in a sheet feeding cassette having a pair of first regulating plates for regulating a position in a width direction of sheets of a predetermined size stacked in a bundle shape, and enables use of a sheet having a small width size in which a width size is smaller than a width size of the sheets having the predetermined size, comprising:

a base plate configured to be placed on an upper surface of a sheet bundle of the predetermined size set in the sheet feeding cassette, and to be movable in a sheet feeding direction through guidance of the pair of first regulating plates, a sheet bundle having a small width size being set on an upper surface of the base plate; and a pair of second regulating plates that are upright from the upper surface of the base plate and regulate a position in a width direction of the sheet bundle of the small width size set on the upper surface of the base plate, wherein the base plate is movable to a sheet feeding position, at which the sheet bundle of the small width size set on the base plate is positioned at a lower side of a predetermined sheet feeding member, and a withdrawing position at which the sheet bundle having the small width size is positioned at a rear side in the sheet feeding direction from the predetermined sheet feeding member, a low friction layer is formed on a lower surface of the base plate, and a frictional coefficient of the low friction layer to the sheet having the predetermined size is smaller than a frictional coefficient of a material of the base plate to the sheet having the predetermined size.

2. The sheet feeding adapter of claim 1, wherein a grip part graspable by a user is connected to the base plate.

3. The sheet feeding adapter of claim 1, wherein the base plate and the second regulating plates are integrally formed with each other by bending one thick sheet.

4. A sheet feeding device comprising:

a sheet feeding cassette which is mounted to an image forming apparatus; and a sheet feeding adapter, which is mounted in the sheet feeding cassette having a pair of first regulating plates for regulating a position in a width direction of sheets of a predetermined size stacked in a bundle shape, and enables use of a sheet having a small width size in which a width size is smaller than a width size of the sheets having the predetermined size, wherein the sheet feeding adapter includes:

a base plate configured to be placed on an upper surface of a sheet bundle of the predetermined size set in the sheet feeding cassette, and to be movable in a sheet feeding direction through guidance of the pair of first regulating plates, a sheet bundle having a small width size being set on an upper surface of the base plate; and a pair of second regulating plates that are upright from the upper surface of the base plate and regulate a position in a width direction of the sheet bundle of the small width size set on the upper surface of the base plate, wherein the base plate is movable to a sheet feeding position, at which the sheet bundle of the small width size set on the base plate is positioned at a lower side of a predetermined sheet feeding member, and a withdrawing position at which the sheet bundle having the small width size is positioned at a rear side in the sheet feeding direction from the predetermined sheet feeding member, the sheet feeding cassette is mounted at a predetermined location inside the image forming apparatus such that the sheet feeding cassette is able to be inserted inward to and pulled outward from the predetermined location through a cassette insertion opening formed in a lateral side of the image forming apparatus, and configured such that an outward side in an inserting/pulling direction of the sheet feeding cassette is located at the rear side in the sheet feeding direction and an inward side in the inserting/pulling direction of the sheet feeding cassette is located at a front side in the sheet feeding direction, a grip part graspable by a user is connected to the base plate, the grip part is formed to protrude to outside of the image forming apparatus through a gap formed between the cassette insertion opening formed in the lateral side of the image forming apparatus and a sidewall at the outward side in the inserting/pulling direction of the sheet feeding cassette when the sheet feeding cassette is mounted at the predetermined location inside the image forming apparatus and the base plate is positioned at the sheet feeding position, a low friction layer is formed on a lower surface of the base plate, and a frictional coefficient of the low friction layer to the sheet having the predetermined size is smaller than a frictional coefficient of a material of the base plate to the sheet having the predetermined size.

5. The sheet feeding device of claim 4, wherein the base plate, the grip part, and the second regulating plates are integrally formed with each other by one thick sheet, and the second regulating plates are formed by bending the one thick sheet.

6. The sheet feeding device of claim 4, wherein the grip part has a plate shape flush with the base plate, and has flexibility in a thickness direction.

* * * * *